US010519740B2

(12) United States Patent
Pray et al.

(10) Patent No.: US 10,519,740 B2
(45) Date of Patent: Dec. 31, 2019

(54) SEALING APPARATUS AND ASSOCIATED METHODS OF MANUFACTURING

(71) Applicant: WEATHERFORD TECHNOLOGY HOLDINGS, LLC, Houston, TX (US)

(72) Inventors: Jeffery Scott Pray, Shenandoah, TX (US); David W. Teale, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 291 days.

(21) Appl. No.: 15/463,837

(22) Filed: Mar. 20, 2017

(65) Prior Publication Data

US 2018/0266202 A1 Sep. 20, 2018

(51) Int. Cl.
*E21B 33/12* (2006.01)

(52) U.S. Cl.
CPC ..... *E21B 33/1208* (2013.01); *E21B 33/1212* (2013.01)

(58) Field of Classification Search
CPC ..... E21B 33/1208; E21B 33/1293; E21B 33/1212; F16J 15/08
See application file for complete search history.

(56) References Cited

U.S. PATENT DOCUMENTS 6,637,750 B2 10/2003 Quoiani
7,134,506 B2 11/2006 Moyes
7,165,622 B2 1/2007 Hirth et al.
7,510,019 B2 3/2009 Li et al.
RE45,518 E 5/2015 Martin et al.
9,097,095 B2 8/2015 Vanlue
9,636,872 B2 5/2017 Batchelder
9,821,339 B2 11/2017 Paschkewitz et al.
(Continued)

FOREIGN PATENT DOCUMENTS

CN 201193495 Y 2/2009
EP 2546557 A1 1/2013
(Continued)

OTHER PUBLICATIONS

Freudenberg; "FlexLok MTM Seals", webpage article, dated 2014, 2 pages.

(Continued)

*Primary Examiner* — Michael R Wills, III
(74) *Attorney, Agent, or Firm* — Smith IP Services, P.C.

(57) ABSTRACT

A method of manufacturing a seal element can include depositing a seal element material from an instrument at a location of the seal element, and depositing another seal element material from the instrument at another location of the seal element, the seal element materials being different from each other. A sealing system can include a seal element, the seal element having at least one seal element material about at least one void in the seal element, the seal element material enclosing the void. Another sealing system can include a seal element, the seal element having multiple different seal element materials deposited at respective multiple different locations in the seal element. Properties or characteristics may gradually change or vary from one seal element material to another seal element material in the seal element. The seal element materials may each include the same basic matrix material.

26 Claims, 12 Drawing Sheets

(56) References Cited

U.S. PATENT DOCUMENTS

| | | | |
|---|---|---|---|
| 9,895,841 | B2 | 2/2018 | Page |
| 2002/0189820 | A1 | 12/2002 | Slup et al. |
| 2006/0207771 | A1 | 9/2006 | Rios, III et al. |
| 2011/0148043 | A1 | 6/2011 | Gaudette et al. |
| 2012/0073343 | A1 | 3/2012 | Prehn |
| 2013/0004664 | A1 | 1/2013 | Agrawal et al. |
| 2013/0022832 | A1 | 1/2013 | Guset et al. |
| 2014/0255198 | A1 | 9/2014 | El-Wardany et al. |
| 2015/0101797 | A1 | 4/2015 | Davies et al. |
| 2015/0217367 | A1 | 8/2015 | Dickey et al. |
| 2015/0218903 | A1 | 8/2015 | Sellers, Jr. et al. |
| 2015/0331402 | A1 | 11/2015 | Lin et al. |
| 2015/0345246 | A1 | 12/2015 | Raynal et al. |
| 2016/0096318 | A1 | 4/2016 | Bickel et al. |
| 2016/0138362 | A1 | 5/2016 | Dockweiler |
| 2016/0258242 | A1 | 9/2016 | Hayter et al. |
| 2017/0072465 | A1 | 3/2017 | Welch et al. |
| 2017/0282457 | A1 | 10/2017 | Burns et al. |
| 2017/0314102 | A1 | 11/2017 | Roy et al. |
| 2017/0314103 | A1 | 11/2017 | Roy et al. |
| 2017/0342797 | A1* | 11/2017 | Murphree ..... E21B 33/1208 |
| 2018/0094494 | A1 | 4/2018 | Basler |

FOREIGN PATENT DOCUMENTS

| | | | |
|---|---|---|---|
| WO | 2003002847 | A1 | 1/2003 |
| WO | 2009098467 | A1 | 8/2009 |
| WO | 2013013975 | A1 | 1/2013 |
| WO | 2017039619 | A1 | 3/2017 |

OTHER PUBLICATIONS

International Search Report with Written Opinion dated Jun. 11, 2018 for PCT Patent Application No. PCT/US18/020073, 17 pages.
International Search Report with Written Opinion dated Feb. 26, 2018 for PCT Patent Application No. PCT/US18/019629, 17 pages.
Office Action dated Feb. 7, 2019 for U.S. Appl. No. 15/464,131, 27 pages.

* cited by examiner

SEALING APPARATUS AND ASSOCIATED METHODS OF MANUFACTURING

BACKGROUND

This disclosure relates generally to equipment utilized and services performed in conjunction with fluid flow control and well integrity/pressure control and, in an example described below, more particularly provides a sealing apparatus and a method of manufacturing same.

A seal may be required to perform its sealing function in a variety of different, very harsh environments. For example, seals used in a downhole environment of a subterranean well may be required to seal against high pressures, at high temperatures and in the presence of abrasives or debris. Other harsh environments may include very low temperatures, vibration or high dynamic loads, exposure to deleterious chemicals or environmental conditions, etc.

It will, thus, be appreciated that improvements are continually needed in the arts of sealing apparatus design and manufacture. Such improvements would be useful for implementation (e.g., for flow control, pressure control, fluid isolation, etc.) in downhole or other harsh environments.

DETAILED DESCRIPTION

Figure 1:
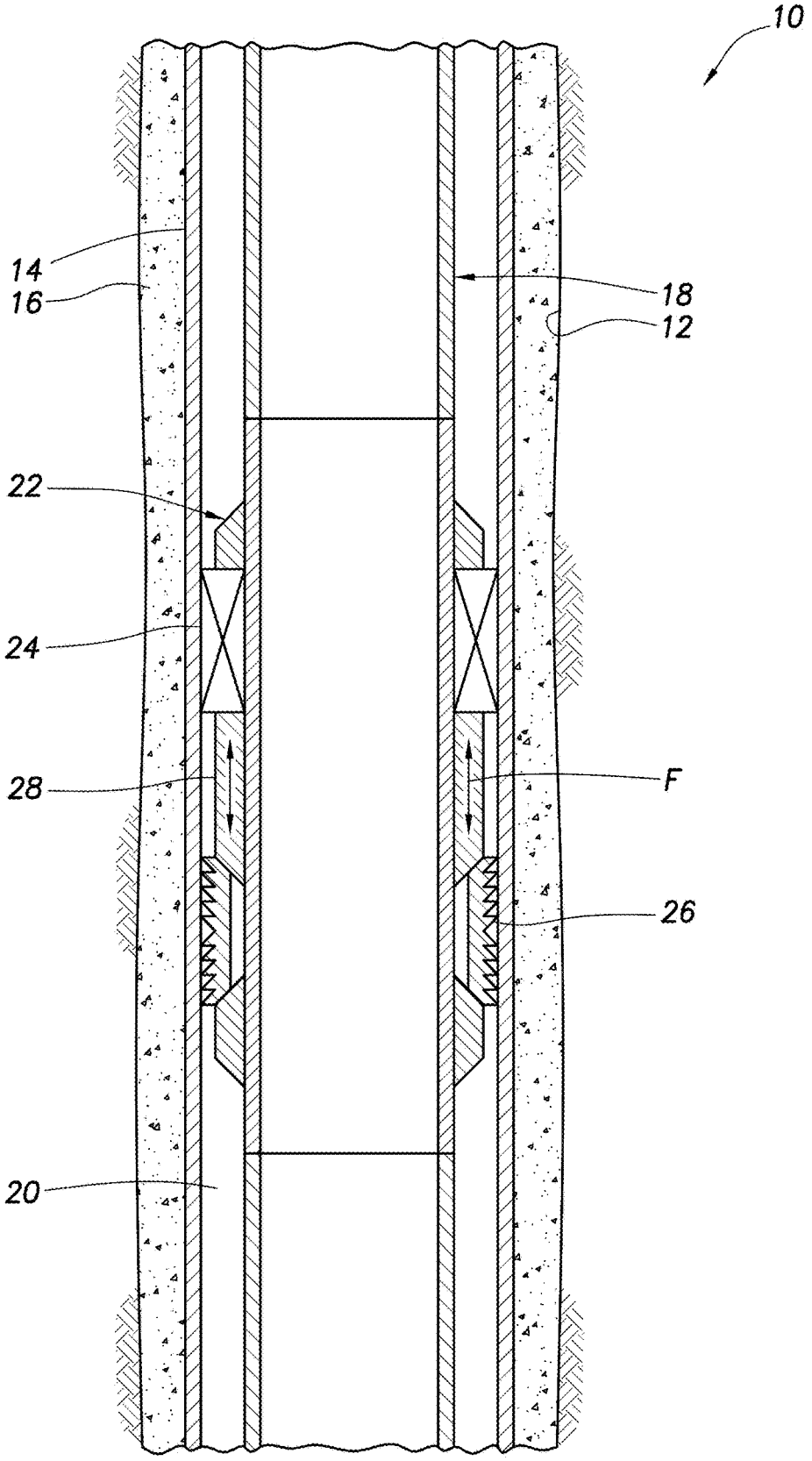
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a generally vertical wellbore 12 has been drilled into the earth, and the wellbore 12 has been lined with casing 14 and cement 16. In other examples, the wellbore 12 may not be vertical, or may not be lined with casing 14 or cement 16. If used, the casing 14 could be in the form of a liner, tubing, pipe or other tubular.

As depicted in FIG. 1, another tubular string 18 is positioned in the wellbore 12. The tubular string 18 could be a production tubing string, a liner string, a work string, a completion string, a sidetracking tool string (e.g., including a whipstock or other deflector), or any other type of tubular string.

To seal off an annulus 20 surrounding the tubular string 18, a packer assembly 22 is connected in the tubular string 18. The packer assembly 22 in this example includes a seal element assembly 24 and an anchor assembly 26.

As described more fully below, the seal element assembly 24 serves to seal off the annulus 20 formed radially between the tubular string 18 and an interior well surface (such as, an interior surface of the casing 14, or an inner wall surface of the wellbore 12 if the wellbore is uncased). The anchor assembly 26 may include one or more slips or other gripping or engagement members to secure the tubular string 18 in the wellbore 12.

Note that it is not necessary for a sealing apparatus incorporating the principles of this disclosure to comprise the packer assembly 22 with the seal element assembly 24 and the anchor assembly 26. The sealing apparatus could be of another type (such as, an internal or external piston sealing apparatus of an actuator, a flange face-sealing apparatus, etc.), and the sealing apparatus could be provided without the anchor assembly 26. Thus, the scope of this disclosure is not limited to any particular details of the packer assembly 22 as described herein or depicted in the drawings.

The packer assembly 22 of FIG. 1 includes an actuator 28. The actuator 28 may be any type of actuator, such as, an electrical, hydraulic, mechanical, thermal, pneumatic or pyrotechnic actuator.

In the FIG. 1 example, the actuator 28 is positioned longitudinally between the seal element assembly 24 and the anchor assembly 26, and the actuator 28 outputs a longitudinal force F that compresses both the seal element assembly 24 and the anchor assembly 26. As a result, the anchor assembly 26 grips or otherwise securely engages the well surface (such as the interior surface of the casing 14 or an interior wall surface of the wellbore 12) by, for example, outwardly extending slips or other engagement members. As another result, the seal element assembly 24 extends radially outward into sealing engagement with the well surface, thereby sealing off the annulus 20.

In other examples, the actuator 28 may not be positioned between the seal element assembly 24 and the anchor assembly 26, the actuator 28 may not longitudinally compress the seal element assembly 24 or the anchor assembly 26, the seal element assembly 24 or the anchor assembly 26 may not extend outward in response to longitudinal compression, etc. The longitudinal force F may be applied from above or below the seal element assembly 24. Thus, the scope of this disclosure is not limited to use of the actuator 28, or to any particular manner of actuating the seal element assembly 24 or the anchor assembly 26.

The seal element assembly 24 can include certain beneficial features, and may be manufactured using certain techniques, as described more fully below. However, it should be fully understood that these features and techniques can be incorporated into other seal element assemblies or other types of sealing apparatus, in keeping with the principles of this disclosure.

Figure 2:
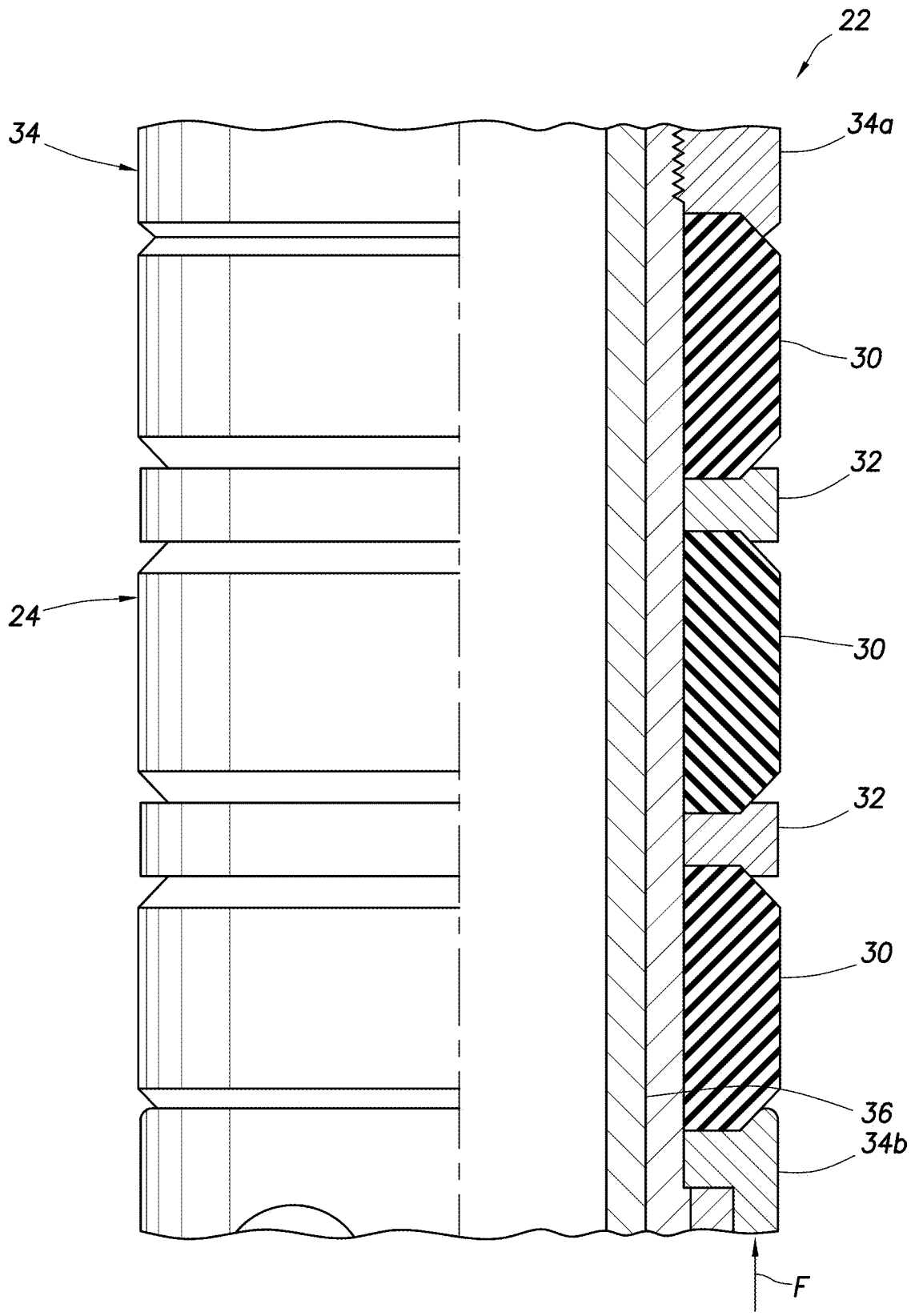
FIG. 2 is a representative partially cross-sectional view of an example of a seal element assembly on a packer assembly that may be used in the system and method of FIG. 1, the seal element assembly including multiple seal elements.

Referring additionally now to FIG. 2, the packer assembly 22 of the FIG. 1 system 10 and method is representatively illustrated with an example of the seal element assembly 24. The FIG. 2 seal element assembly 24 may be used with other packer assemblies, or in other systems or methods, in keeping with the principles of this disclosure.

In the FIG. 2 example, the seal element assembly 24 includes multiple longitudinally distributed annular seal elements 30, with spacers 32 between the seal elements 30. The seal elements 30 and spacers 32 are positioned on a housing assembly 34 including upper and lower sections 34*a,b*. When the lower housing section 34*b* is displaced toward the upper housing section 34*a* (such as, by the force F output by the actuator 28), the seal elements 30 are longitudinally compressed and extend radially outward as a result.

The seal element assembly 24 and the housing assembly 34 are arranged on an inner, generally tubular mandrel 36. The seal elements 30 may be maintained stationary on the inner mandrel 36, or they may be permitted to displace longitudinally on the inner mandrel 36. In some examples, the force F may be applied in response to manipulation of the inner mandrel 36 (such as, by rotating, raising and/or lowering the inner mandrel 36 from surface), or by creating a pressure differential across or within the inner mandrel 36 (such as, by positioning a plug in the inner mandrel and applying pressure to the tubular string 18 above the plug, creating a pressure differential between an interior of the inner mandrel 36 and the annulus 20, etc.).

In the FIG. 2 example, the upper and lower seal elements 30 can be made of a harder, tougher and more extrusion-resistant material as compared to the middle seal element 30. The middle seal element 30 may be made of a softer and more compressible material for primary sealing against a well surface. Using the principles of this disclosure, the seal elements 30 may be separately constructed, or their separate capabilities (e.g., extrusion resistance, primary sealing, etc.) may be combined into a single seal element.

As described more fully below, each of the individual seal elements 30 may be manufactured and configured using the principles of this disclosure, and those principles can in some examples be utilized to combine multiple components (such as, the seal elements 30, the spacers 32 and the housing assembly 34) into a single, multifunctional integrated component.

Figure 3:
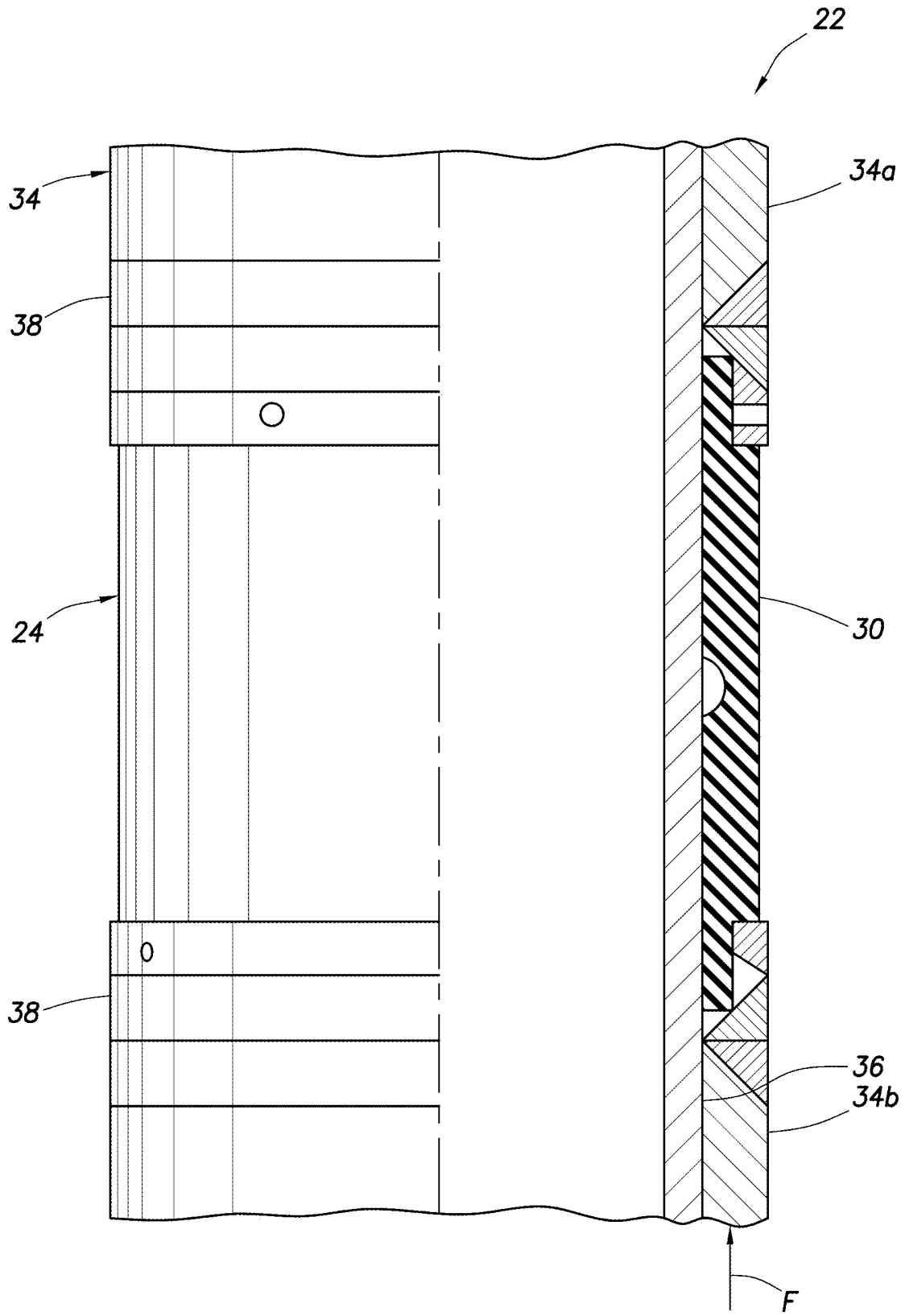
FIG. 3 is a representative partially cross-sectional view of another example of the seal element assembly, the seal element assembly including a single seal element.

Referring additionally now to FIG. 3, the packer assembly 22 of the FIG. 1 system 10 and method is representatively illustrated with another example of the seal element assembly 24. In this example, the seal element assembly 24 includes only a single seal element 30.

In addition, anti-extrusion devices 38 are positioned straddling the seal element 30. The anti-extrusion devices 38 extend radially outward in response to application of the force F, in order to close off annular gaps between the housing assembly 34 and the well surface to be sealingly engaged by the seal element 30.

As with the FIG. 2 example discussed above, the seal elements 30 depicted in FIG. 3 may be manufactured and configured using the principles of this disclosure, and those principles can in some examples be utilized to combine multiple components (such as, the seal element 30, the anti-extrusion devices 38 and the housing assembly 34) into a single, multifunctional integrated component.

Figure 4:
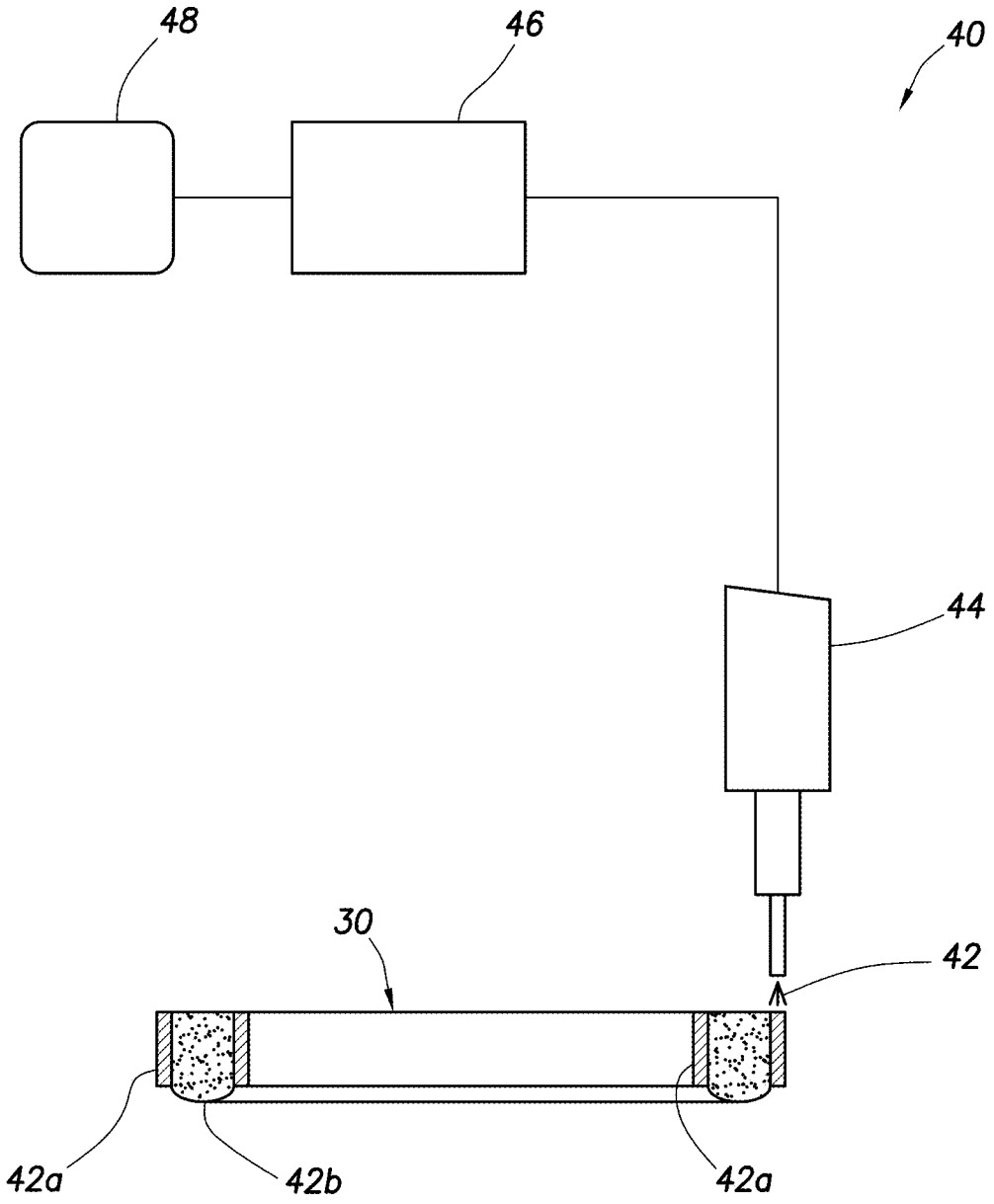
FIG. 4 is a representative partially cross-sectional view of an example of a seal element being manufactured.

Referring additionally now to FIG. 4, an example method 40 of manufacturing a seal element 30 is representatively illustrated. The seal element 30 example depicted in FIG. 4 may be used in the seal element assemblies 24 described herein, or the seal element 30 may be used in other sealing apparatus.

In the FIG. 4 example, a seal element material 42 is progressively deposited by an instrument 44 to thereby construct the seal element 30. The material 42 may be deposited by, for example, spraying, ejecting, dispensing, pouring or otherwise placing the material 42 so that it becomes an integral part of the seal element 30. In this example, each successive pass of deposited material 42 becomes bonded to or fused with at least one selected previously deposited pass of the material 42, so that the seal element 30 is gradually built up as an integral combination of all of the passes of the material 42 deposited by the instrument 44.

The instrument 44 is controlled (e.g., spatial coordinates, motion characteristics, material 42 flow rate and type, etc.) by a control system 46. The control system 46 is provided with certain inputs 48 (such as, operator inputs, three-dimensional models, pre-programmed instructions, etc.).

The control system 46 can cause the instrument 44 to deposit the seal element material 42 so that the resulting seal element 30 is constructed with certain unique features that enhance the functionality of the seal element 30. These features may include those that increase the seal element's 30 sealing ability, resistance to pressure differentials, abrasion resistance, fatigue resistance, temperature capability, resistance to well fluids, endurance and reliability.

In some examples, the seal element material 42 deposited by the instrument 44 can be a metallic material. The seal element material 42 may comprise one or more metals or metal alloys. As used herein, the terms "metal," "metallic" and similar terms refer to materials comprising, in whole or in part, at least one metal or metal alloy.

In harsh environments, the seal element material 42 may advantageously comprise a metal or metallic material. Such materials generally possess superior properties as compared to other materials (such as elastomers or other polymers). However, it is not necessary for all or any portion of the seal element 30 to comprise a metal or metallic material in keeping with the scope of this disclosure.

The control system 46 can cause the instrument 44 to vary selected properties of the seal element material 42 while it is being deposited to construct the seal element 30. In the FIG. 4 example, one seal element material 42*a* may be deposited to form inner and outer sealing surfaces of the seal element 30, and another seal element material 42*b* may be deposited to form a central resilient body of the seal element 30.

Although the seal element materials 42*a,b* are depicted in FIG. 4 as being separate, discrete components of the seal element 30, there may instead be a gradual change from one material to another, such as, by gradually varying a ratio of the materials 42*a,b*, or by gradually varying a characteristic of the material 42 (for example, a density, size, quantity, shape, etc. of voids in the material 42). Thus, as used herein, the term "material" is used to indicate a substance with certain physical properties, and those physical properties may change from one location to another in the seal element 30. The physical properties can be changed gradually using the method 40, so that there is no distinct boundary between the materials 42*a,b*.

In one example, the seal element material 42*a* could have relatively high toughness, strength, hardness, abrasion resistance, pressure differential resistance, durability, resistance to well fluids and/or temperature resistance as compared to the seal element material 42*b*. The seal element material 42*a* could comprise a relatively deformable metal, such as aluminum or magnesium, in order to enhance its capability to seal against irregular surfaces. However, the scope of this disclosure is not limited to use of any particular material types or properties for the seal element material 42*a*.

The seal element material 42*b* could have relatively high resilience and compressibility as compared to the seal element material 42*a*, as well as other adequate material properties to withstand its intended environment. In this example, the seal element material 42*b* serves to outwardly bias the seal element material 42*a* (so that the seal element material 42*a* sealingly engages another surface), and can enable the seal element material 42*a* to conform to a well surface it engages. The seal element material 42*b* could comprise a metal (such as a metal foam), an elastomer or other polymer, a combination of different materials, etc. The scope of this disclosure is not limited to use of any particular material types or properties for the seal element material 42*b*.

The seal element materials 42*a,b* can in some examples comprise a same basic matrix material, but with at least one change that affects a material property. For example, one of the seal element materials 42*a,b* could comprise a metal, and the other seal element material could comprise the same metal, but with pores or voids that cause the resulting porous metal to be more compressible and less dense as compared to the non- or less-porous metal. In this example, the same instrument 44 can deposit both of the materials 42*a,b*, and change between the materials 42*a,b* by varying a size, number, location, etc. of pores or voids in the seal element material 42.

In other examples, the seal element materials 42*a,b* may comprise completely different materials. For example, one of the seal element materials 42*a,b* could comprise a metal, and the other seal element material could comprise an elastomer. The same instrument 44 may deposit the different seal element materials 42*a,b*, or different instruments 44 may deposit the respective different seal element materials 42*a,b*.

Figure 5:
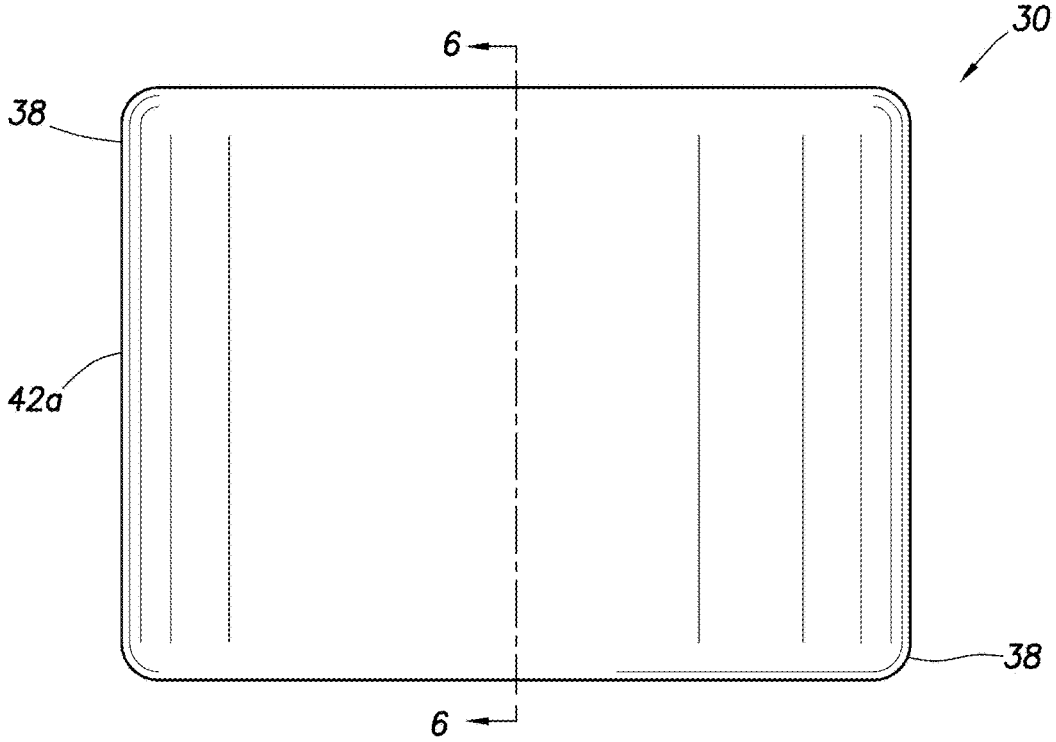
FIGS. 5 & 6 are representative elevational and cross-sectional views, respectively, of another seal element example.
Figure 6:
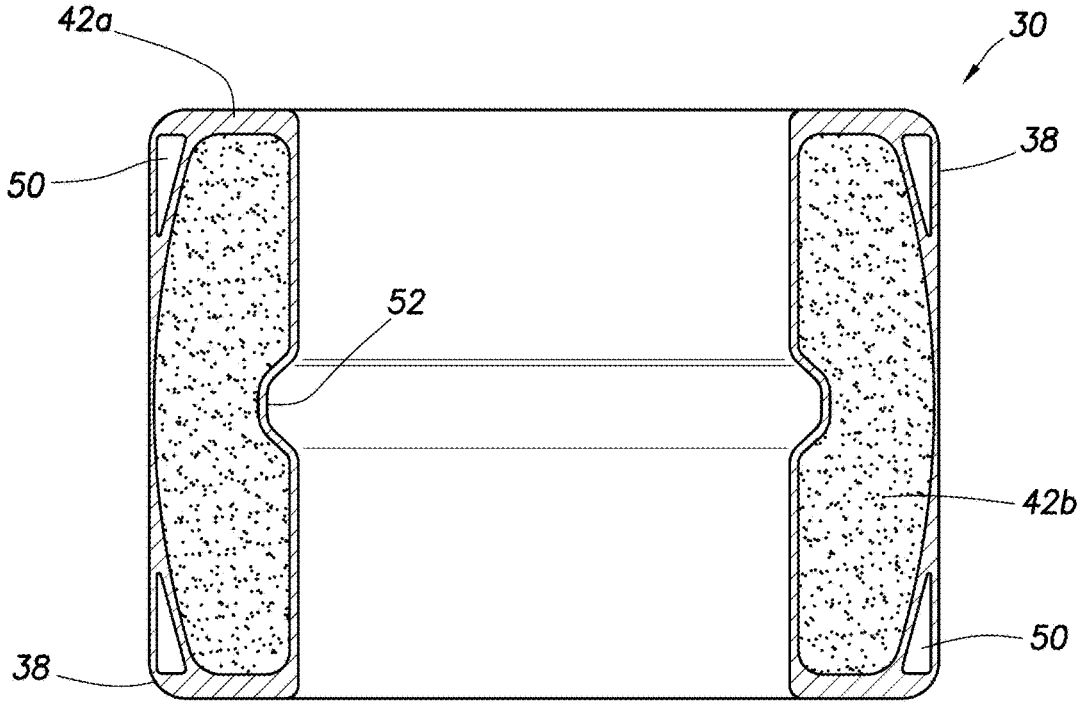

Referring additionally now to FIGS. 5 & 6, another example of the seal element 30 is representatively illustrated in elevational and cross-sectional views (FIG. 6 being taken along line 6-6 of FIG. 5). The seal element 30 of FIGS. 5 & 6 may be used in any of the seal element assemblies 24 described herein, or in any other sealing apparatus.

In the FIGS. 5 & 6 example, the seal element material 42*a* forms an entire external surface of the seal element 30, completely enclosing the seal element material 42*b* and annular voids 50 near opposite outer ends of the seal element 30. The voids 50 are positioned radially outward relative to opposite longitudinal ends of the seal element material 42*b*, so that the material 42*a* surrounding the voids 50 can collapse as the seal element 30 is longitudinally compressed. In this manner, the seal element material 42*a* bounding the voids 50 can serve as anti-extrusion devices 38 to close off annular gaps between the ends of the seal element 30 and the well surface to be sealingly engaged by the seal element 30.

An annular recess 52 is formed in an interior of the seal element 30. In this example, the recess 52 is located approximately at a longitudinal middle of the seal element 30, but the recess 52 could be otherwise positioned in other examples.

The recess 52 enables the longitudinal middle portion of the seal element 30 to extend radially outward as the seal element 30 is longitudinally compressed. Thus, between the anti-extrusion devices 38, the seal element 30 will be extended outward into sealing engagement with the well surface.

In one example, the seal element material 42*a* may comprise a metal, and the seal element material 42*b* may comprise a metal foam or porous metal. The metal of the seal element material 42*a* may be the same as the metal of the seal element material 42*b*, or they may be different metals.

In this example, the seal element material 42*a* has a greater density, toughness, resistance to well fluids and abrasion resistance as compared to the seal element material 42*b*. However, the seal element material 42*b* has a greater compressibility as compared to the seal element material 42*a*.

The seal element material 42*b* can be designed to inwardly support the seal element material 42*a* in sealing contact with the well surface, while allowing the seal element material 42*a* to conform to any irregularities in the well surface. One technique to accomplish this result is to provide an appropriate number and size of pores or voids in the seal element material 42*b* (e.g., select a porosity of the material), so that the material deforms when a selected pressure is applied to the material, thereby limiting contact pressure and allowing the contact pressure to be more consistent across the sealing surface of the seal element 30.

It is expected that an increase in porosity of the seal element material 42*b* will result in a corresponding decrease in maximum contact pressure, and a decrease in porosity will result in a corresponding increase in maximum contact pressure. However, other techniques for varying or limiting contact pressure may be used. For example, the seal element material 42*b* could comprise another metal, the metal could be heat treated differently, different proportions of metals or other materials could be used (such as, varying proportions of metals and elastomers or other polymers), etc.

Figure 7:
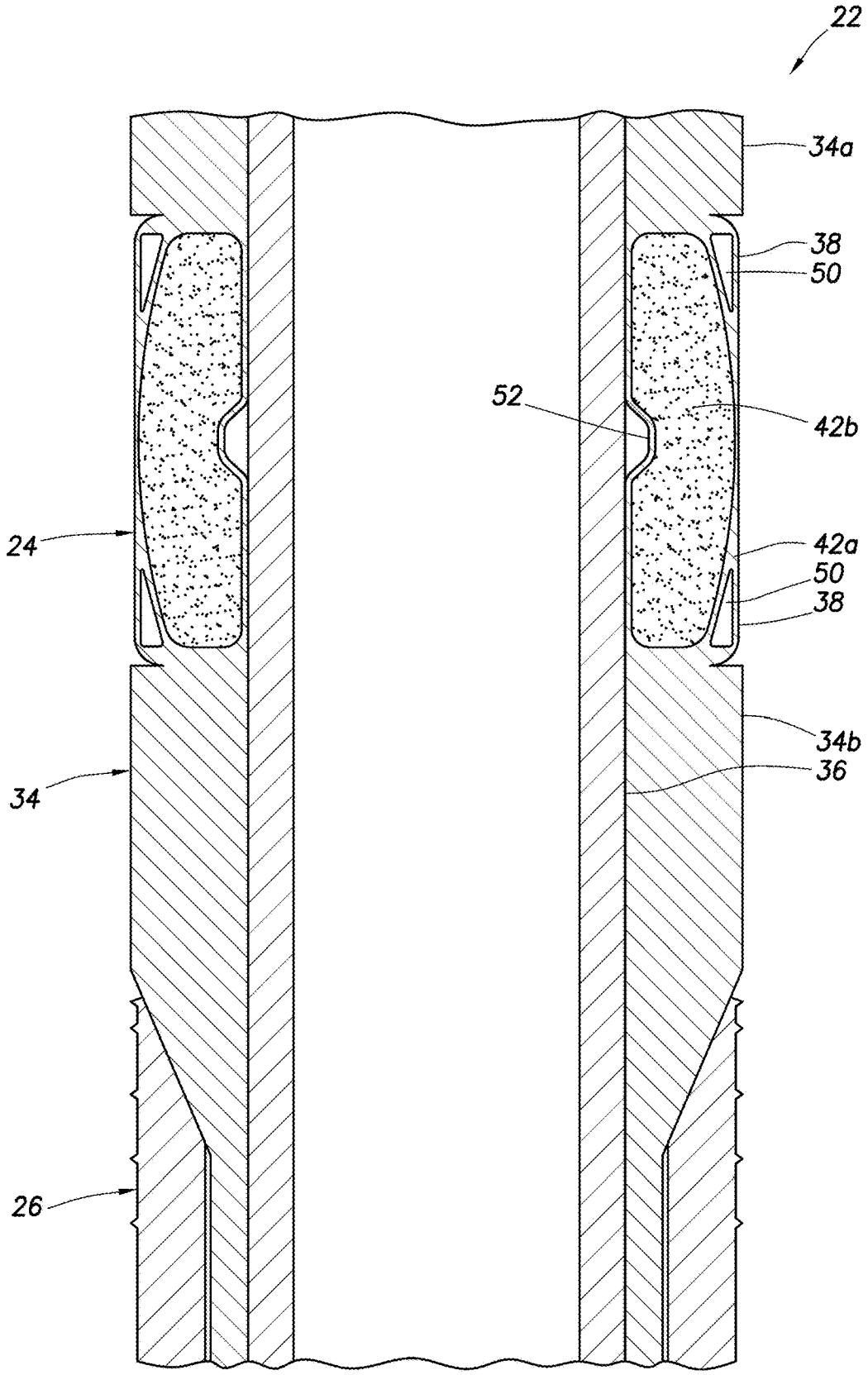
FIG. 7 is a representative cross-sectional view of a well tool having another seal element example incorporated therein.

Referring additionally now to FIG. 7, another example of the packer assembly 22 is representatively illustrated. In this example, the seal element assembly 24 and the housing assembly 34 are integrally formed as a single component. In other examples, other or different components of the packer 22 can be integrated together into a single component (such as the spacers 32 and seal elements 30 of the FIG. 2 example, if multiple seal elements 30 are used, or the seal element 30 and inner mandrel 36 of the FIG. 3 example).

Figure 8:
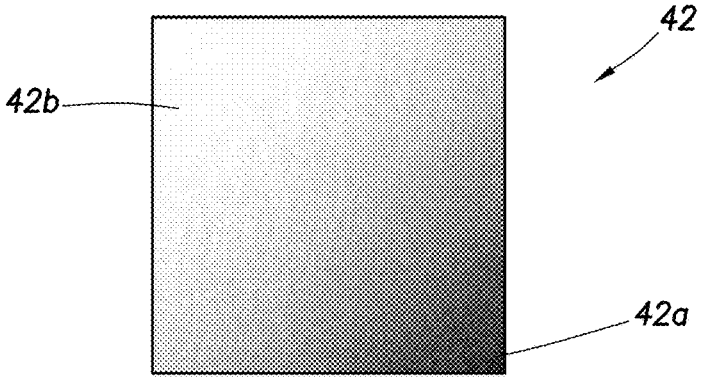
FIGS. 8-14 are representative cross-sectional views of various examples of seal element materials and configurations.
Figure 9:
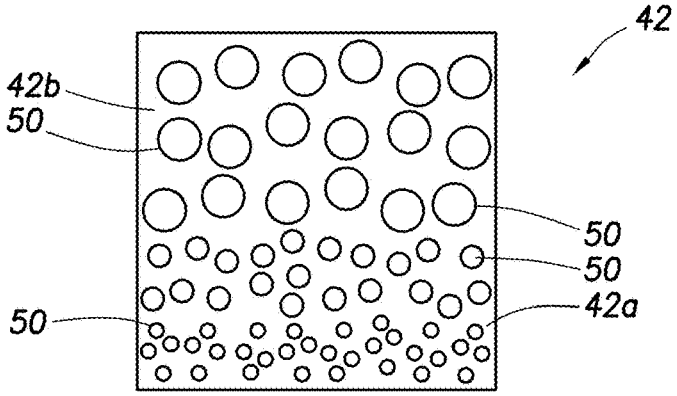
Figure 10:
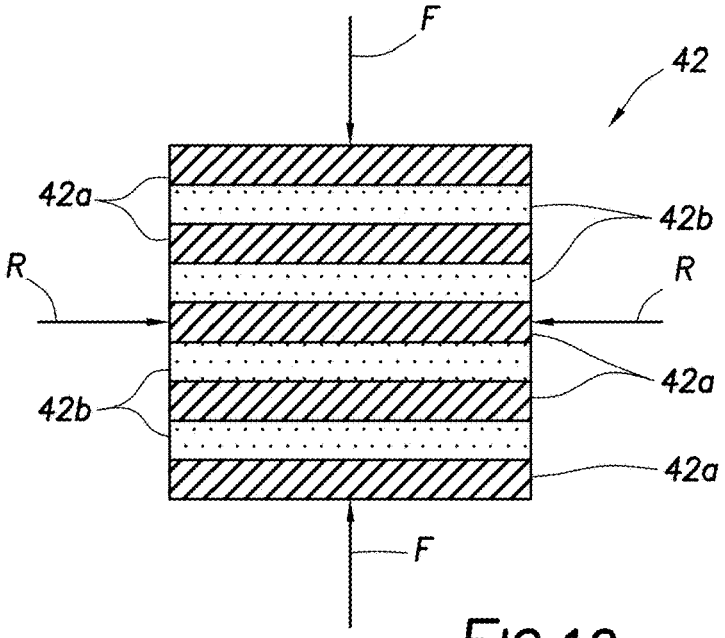

Referring additionally now to FIGS. 8-10, various techniques for varying material properties in the seal element 30 are representatively illustrated. These techniques can be performed using the method 40 and apparatus (e.g., the instrument 44 and control system 46) of FIG. 4, or other methods or apparatus may be used.

In the FIG. 8 example, properties of the seal element material 42 gradually change between the materials 42*a,b*. This result could be accomplished, for example, by first depositing one of the materials 42*a,b* from the instrument 44 in the method 40 of FIG. 4, and then gradually increasing a proportion of the other material deposited from the instrument 44.

A ratio of the materials 42*a,b* can be varied as the seal element material 42 is deposited from the instrument 44 to form the seal element 30. This varying of the ratio can be an increase, a decrease, or any combination or pattern of increases and decreases, and can be performed continuously, intermittently, incrementally, periodically or otherwise, in order to vary any selected material property or properties.

For example, a metallic proportion of the seal element material 42 could be varied during the method 40, so that the material 42*a* comprises a significantly greater proportion of metal, as compared to the material 42*b*. In this manner, the material 42*a* could have increased abrasion resistance, pressure differential resistance, strength, well fluids resistance, density, toughness or durability as compared to the material 42*b*, and the material 42*b* can have increased compressibility, increased resilience or decreased density as compared to the material 42*a*.

In the FIG. 9 example, material properties of the seal element material 42 are varied by altering a number, size, location, shape or density (void volume/gross material volume) of voids 50 in the seal element material 42. The material 42*a* in this example comprises a greater number of the voids 50 per unit volume as compared to the material 42*b*, but the voids 50 in the material 42*a* are smaller in size and more densely packed as compared to the material 42*b*. The density and strength of the seal element material 42 generally increases, and its compressibility generally decreases, with corresponding decreases in void 50 size or quantity per unit volume, and vice versa.

Characteristics of the voids 50 (size, quantity, density, shape, etc.) can be varied as the seal element material 42 is deposited from the instrument 44 to form the seal element 30. This varying of the void characteristics can be an increase, a decrease, or any combination or pattern of increases and decreases, and can be performed continuously, intermittently, incrementally, periodically or otherwise, in order to vary any selected material property or properties.

In the FIG. 10 example, the seal element material 42 includes multiple alternating sections of the materials 42*a,b*. The materials 42*a,b* alternate in a longitudinal direction (from top to bottom as viewed in FIG. 10). Arranged in this manner, the materials 42*a,b* may be considered as being configured in an alternating "series" in the longitudinal direction, and in "parallel" in a lateral or radial direction.

If the material 42*a* has greater rigidity and less compressibility as compared to the material 42*b*, then the alternating sections of the materials 42*a,b* in the FIG. 10 example will result in the seal element material 42 having greater compressibility and less rigidity in the longitudinal direction as compared to the lateral or radial direction. As depicted in FIG. 10, the longitudinal force F (output by the actuator 28 of FIG. 1, for example) will produce more compression of the seal element material 42 than an equivalent lateral or radial force R will produce in the lateral or radial direction.

When used in the seal element 30 of the packer assembly 22 of FIG. 1, the seal element material 42 configuration of FIG. 10 will allow the seal element 30 to be more readily compressed longitudinally by the force F, and its enhanced radial rigidity will allow it to maintain sealing contact with a well surface.

Note that it is not necessary for the materials 42*a,b* to be formed as separate discrete layers. Material properties of the seal element material 42 could instead be gradually varied (e.g., as in the FIGS. 8 & 9 examples). It is also not necessary for the materials 42*a,b* to alternate, or to alternate in any particular direction(s). For example, the materials 42*a,b* could alternate in the lateral or radial direction, so that the seal element 30 is more readily compressed radially or laterally.

In some examples, the materials 42*a,b* can be arranged so that the seal element 30 deforms in a desired manner in response to force applied thereto. Thus, desired displacements of different portions of the seal element 30 can be pre-programmed or preselected by appropriately arranging the materials 42*a,b*. For example, it may be desirable for an anti-extrusion portion of the seal element 30 (such as the anti-extrusion device 38 of the FIGS. 5-7 examples) to extend into contact with a well surface prior to a primary sealing portion of the seal element 30 extending into contact with the well surface.

Figure 11:
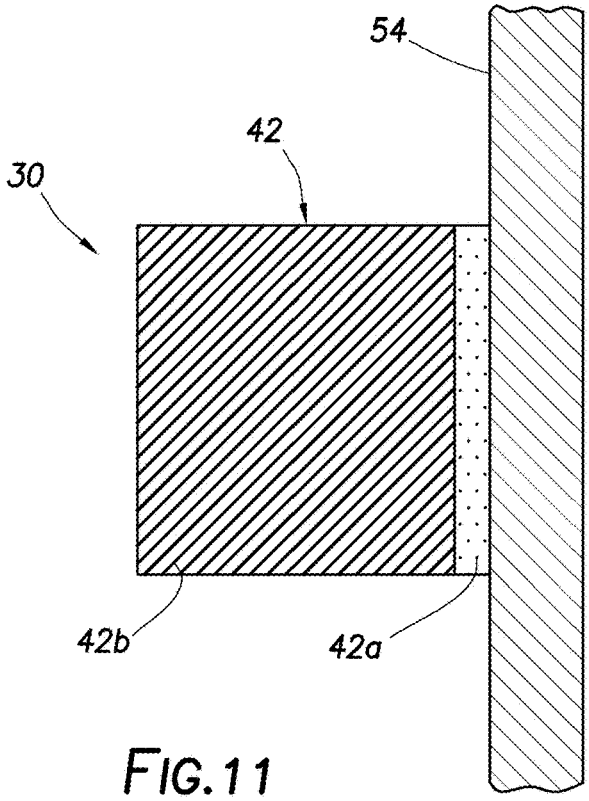
Figure 12:
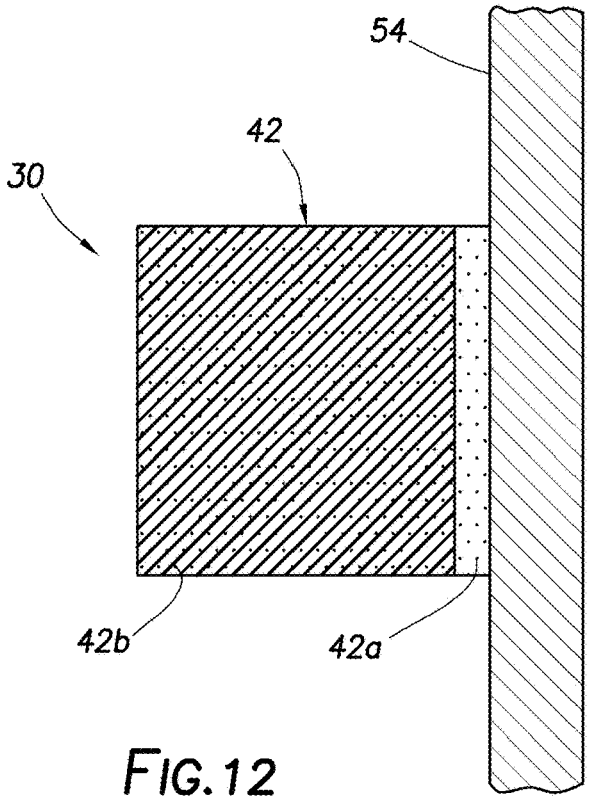

Referring additionally now to FIGS. 11 & 12, additional examples of the seal element material 42 are representatively illustrated. In these examples, the seal element material 42 is configured to be resiliently biased into sealing contact with a well surface 54, and to conform to any irregularities of the well surface 54. The well surface 54 could be an inner surface of the casing 14 or an inner wall of the wellbore 12 in the FIG. 1 example, or it could be another well surface.

In the FIG. 11 example, the material 42*a* forms a sealing surface on the seal element 30 for sealing engagement with the well surface 54. The material 42*a* may be more abrasion resistant, fatigue resistant, well fluids resistant, tough, dense, strong, rigid or metallic as compared to the material 42*b*.

The material 42*b* can deform to allow the seal element 30 to conform to the well surface 54. For example, the material 42*b* could comprise a porous material (such as, a metal foam or a porous metal) that inelastically compresses when a sufficient pressure is applied to it. In other examples, the material 42*b* could comprise a resilient material (such as an elastomer) that elastically compresses and expands to maintain a biasing pressure against the material 42*a*. Any types, numbers or combinations of materials may be used for the materials 42*a,b* in the FIGS. 11 & 12 examples.

The material 42*a* in the FIG. 11 example could comprise a relatively easily deformable material, in order to allow the material 42*a* to readily conform to the well surface 54. For example, the material 42*a* could comprise a metal foam or relatively porous metal. In that case, the material 42*b* could be more abrasion resistant, fatigue resistant, well fluids resistant, tough, dense, strong, rigid or metallic as compared to the material 42*a*.

In the FIG. 12 example, the material 42*a* is similar to, or the same as, the material 42*a* in the FIG. 11 example. However, the same material is also present in the material 42*b*, but at a lower proportion. That is, the material 42*a* is one of multiple components of the material 42*b*.

For example, the material 42*b* could comprise a greater proportion of a more compressible or more resilient component, as compared to the material 42*a*. As another example, the material 42*b* could comprise a harder material (such as hardened steel) dispersed in a softer matrix (such as aluminum).

Figure 13:
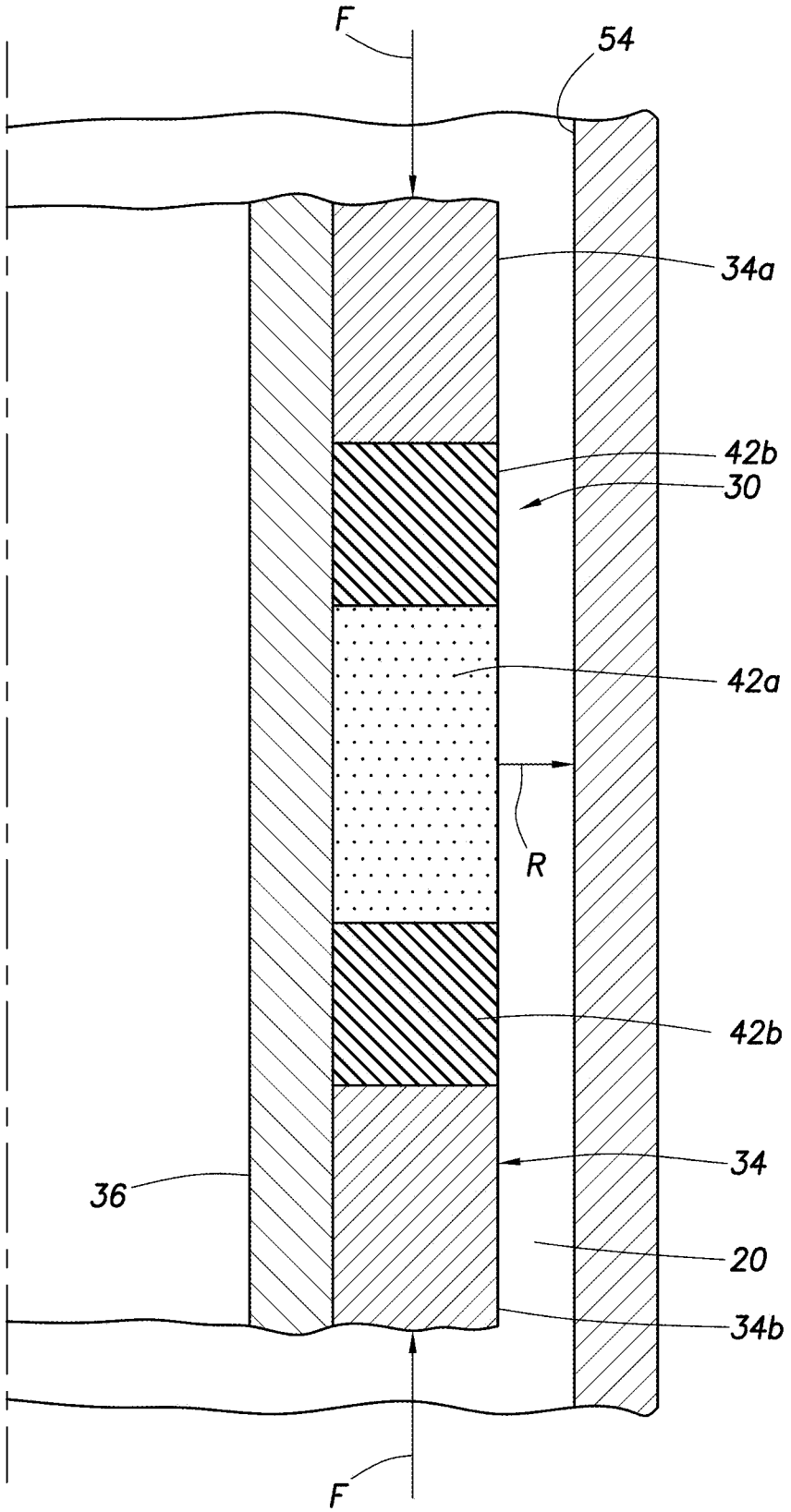

Referring additionally now to FIG. 13, another example of the seal element 30 is representatively illustrated. In this example, the seal element material 42*a* is straddled longitudinally by the seal element materials 42*b* on the inner mandrel 36.

The material 42*a* in the FIG. 13 example is more compressible and deformable as compared to the material 42*b*. Thus, in response to application of the longitudinally compressive force F, the material 42*a* will extend radially outward more than the material 42*b*, and will eventually apply a radially directed force R for sealing contact with the well surface 54. The material 42*b* may also extend into sealing contact with the well surface 54, or at least block the annular gaps between the well surface 54 and the seal element 30 or housing assembly 34.

Figure 14:
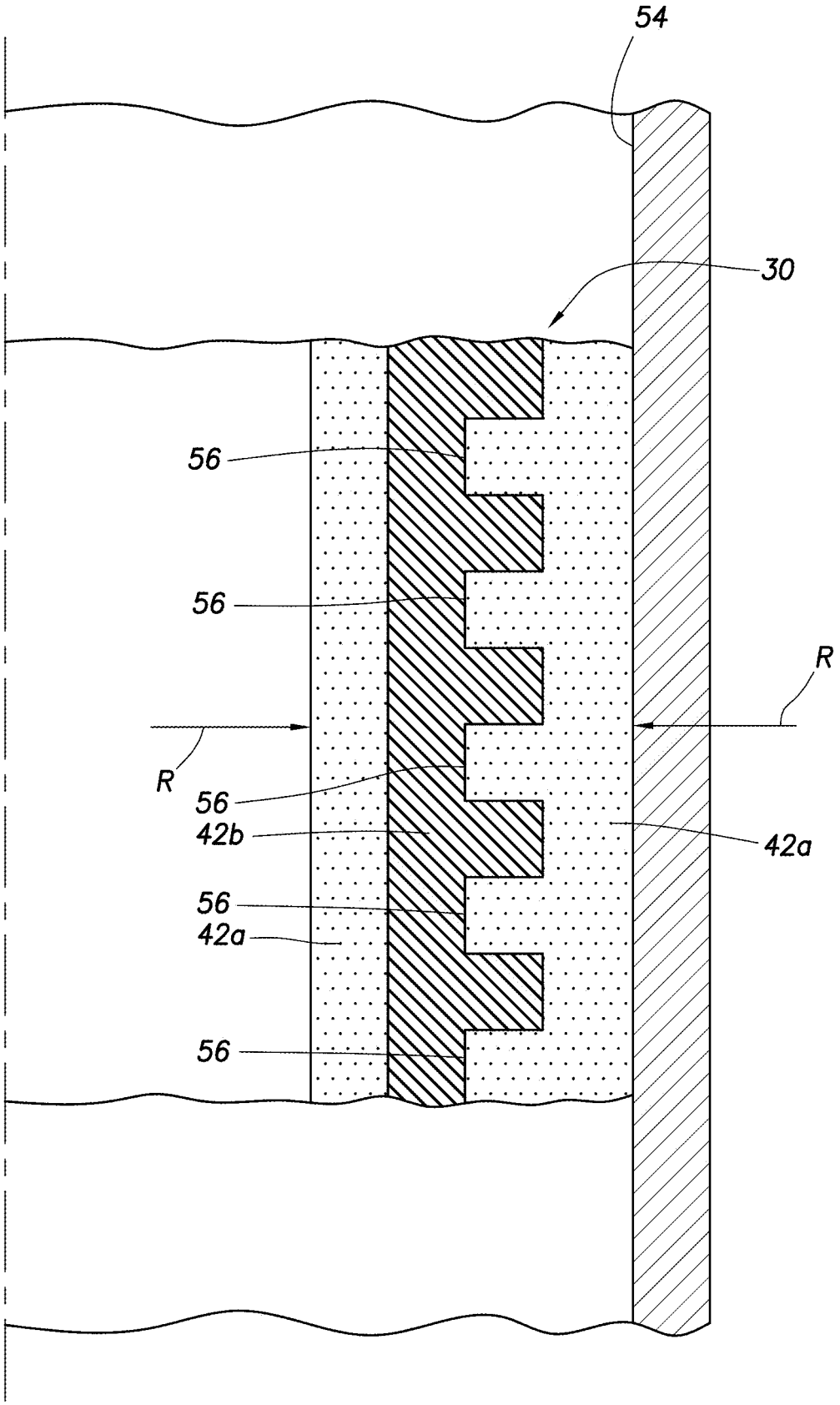

Referring additionally now to FIG. 14, another example of the seal element 30 is representatively illustrated. In this example, the seal element 30 includes internal structures 56 that limit radial compression of the seal element 30.

As depicted in FIG. 14, the structures 56 are formed as annular projections extending inwardly from the material

42*a*, which is more rigid as compared to the material 42*b*. The material 42*a* radially straddles the material 42*b*, so that the material 42*b* is compressed radially between the inner and outer material 42*a* when the radial force R is applied as a result of the longitudinal force F (see FIG. 13).

In the FIG. 14 example, the structures 56 extend radially inward from the outer material 42*a*. In other examples, the structures 56 could extend radially outward from the inner material 42*a*, the structures 56 could be formed of the material 42*b*, or the structures 56 could be otherwise formed, configured or positioned.

The structures 56 in the FIG. 14 example allow the material 42*b* to be compressed between the inner and outer material 42*a*, but the structures 56 limit the compression to a selected amount. The selected amount may be varied by changing thicknesses and spacings between the materials 42*a,b*, or changing dimensions of the structures 56.

Figure 15:
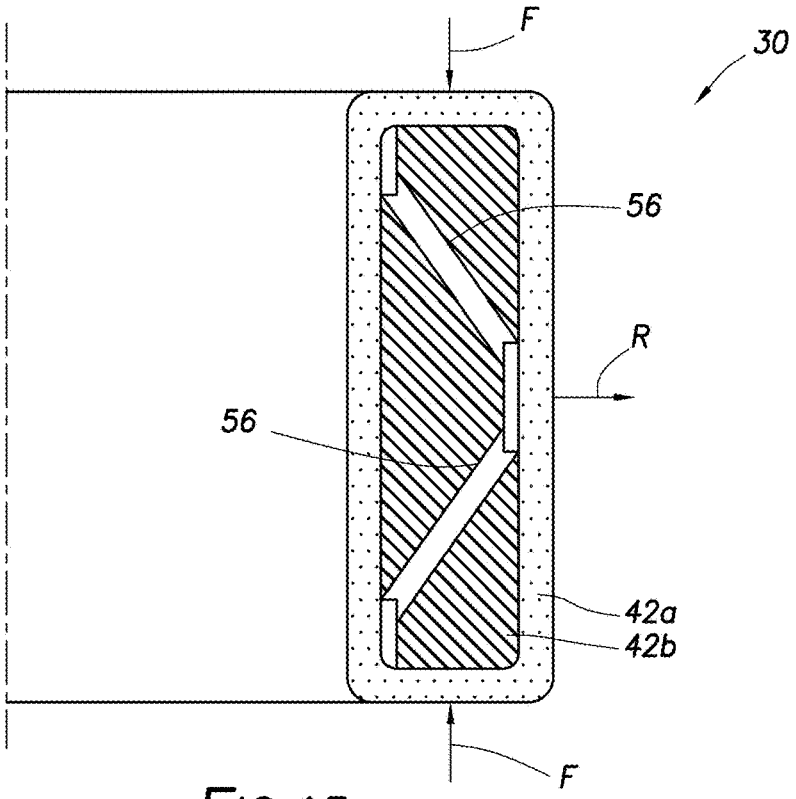
FIGS. 15 & 16 are representative cross-sectional views of examples of seal elements with various structures formed therein.

Referring additionally now to FIG. 15, another example of the seal element 30 is representatively illustrated. In this example, the internal structures 56 enhance radial extension of the seal element 30 in response to application of the longitudinally directed force F.

Note that the structures 56 are configured and arranged, so that they will bias a middle section of the seal element 30 radially outward as the seal element 30 is longitudinally compressed. The structures 56 may be formed of the material 42*a*, the material 42*b* or other material(s). The structures 56 may be discrete, separate components, or they may be integrally formed with other components of the seal element 30.

Figure 16:
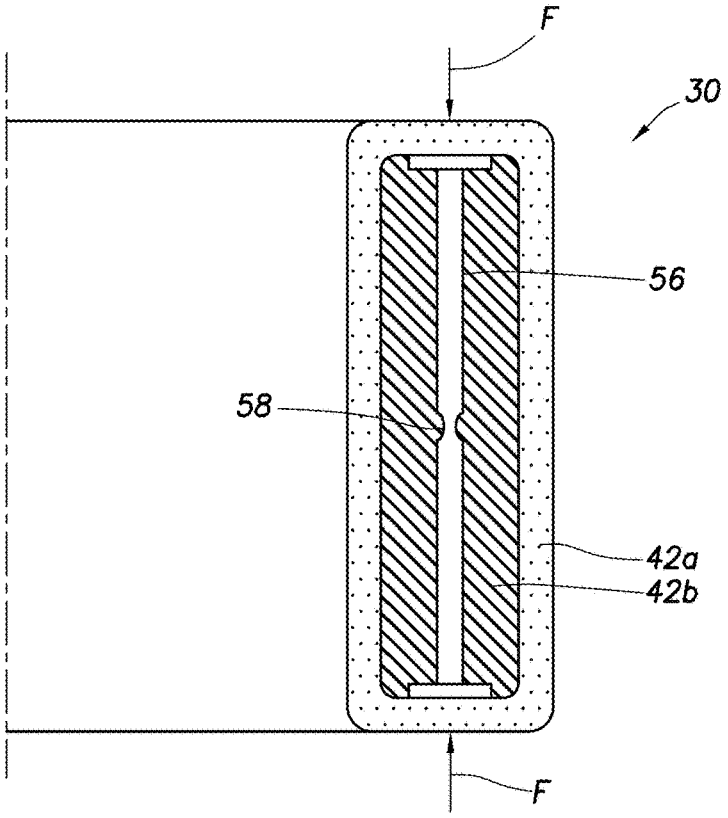

Referring additionally now to FIG. 16, another example of the seal element 30 is representatively illustrated. In this example, the internal structures 56 are formed as longitudinally extending and circumferentially spaced apart frangible columns or supports that initially prevent longitudinal compression of the seal element 30. This could, for example, prevent inadvertent "pre-setting" of the packer assembly 22 (see FIG. 1) or other sealing apparatus.

However, when a sufficient predetermined longitudinal force F is applied to the seal element 30, the structures 56 will break or otherwise cease to prevent longitudinal compression of the seal element 30. For this purpose, one or more weakened portions 58 could be provided on the structures 56. The structures 56 may be formed of the material 42*a*, the material 42*b* or other material(s). The structures 56 may be discrete, separate components, or they may be integrally formed with other components of the seal element 30.

Figure 17:
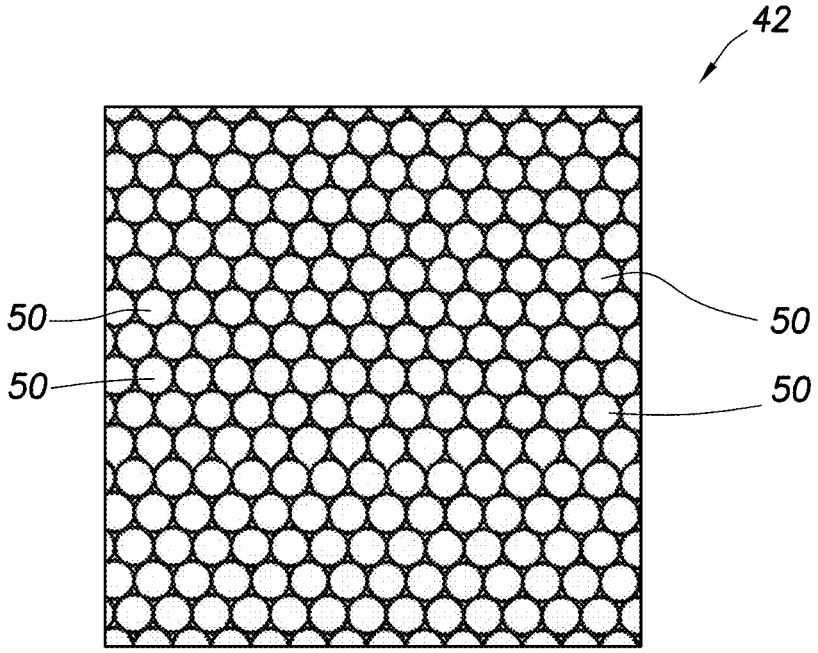
FIGS. 17 & 18 are representative cross-sectional views of additional seal element material examples.

Referring additionally now to FIG. 17, another example of the seal element material 42 is representatively illustrated. In this example, the seal element material 42 has a substantial quantity of pores or voids 50 therein.

The seal element material 42 may be "open-celled" in that the pores or voids 50 are substantially interconnected with each other, and with an exterior of the seal element material 42. Thus, characteristics of the pores or voids 50 (such as quantity, size, density, shape, etc.) can be varied, in order to change a total surface area of the seal element material 42 exposed to well fluids or other downhole elements.

If, for example, it is desired for the seal element material 42 to eventually dissolve or otherwise degrade after exposure to well fluids, then the characteristics of the pores or voids 50 can be designed so that the dissolving or other degrading occurs upon passage of a selected period of time. As another example, heat transfer through the seal element material 42 may be varied by changing the characteristics of the pores or voids 50.

The seal element material 42 may be "closed-celled" in that the pores or voids 50 are substantially isolated from each other and the exterior of the seal element material 42. In this case, the pores or voids 50 may be empty, or they may contain a fluid, gel, gas or other material.

Material in the pores or voids 50 can be used to modify or enhance properties of the seal element material 42. For example, a compressible material (such as a gas at a selected pressure) could be contained in the pores or voids 50 to modify the compressibility of the seal element material 42. As another example, a resilient material (such as an elastomer) could be contained in the pores or voids 50 to increase the resilience of the seal element material 42.

The material in the pores or voids 50 could be gradually released from the pores or voids (for example, if the seal element material 42 is open-celled). Alternatively, the material in the pores or voids 50 could be released upon compression or other deformation of the seal element material 42.

A material in the pores or voids 50 could enhance properties (such as, strength, toughness, hardness, etc.) during heat treatment of the seal element material 42. A lubricant in the pores or voids 50 can enhance lubricity of the seal element material 42. A solvent or swell-activating agent in the pores or voids 50 can cause the seal element material 42 to dissolve or swell, respectively, after a selected period of time, or upon exposure to a particular environmental condition (such as elevated temperature). Thus, the scope of this disclosure is not limited to any particular purpose or result of disposing any material in the pores or voids 50 of the seal element material 42.

Figure 18:
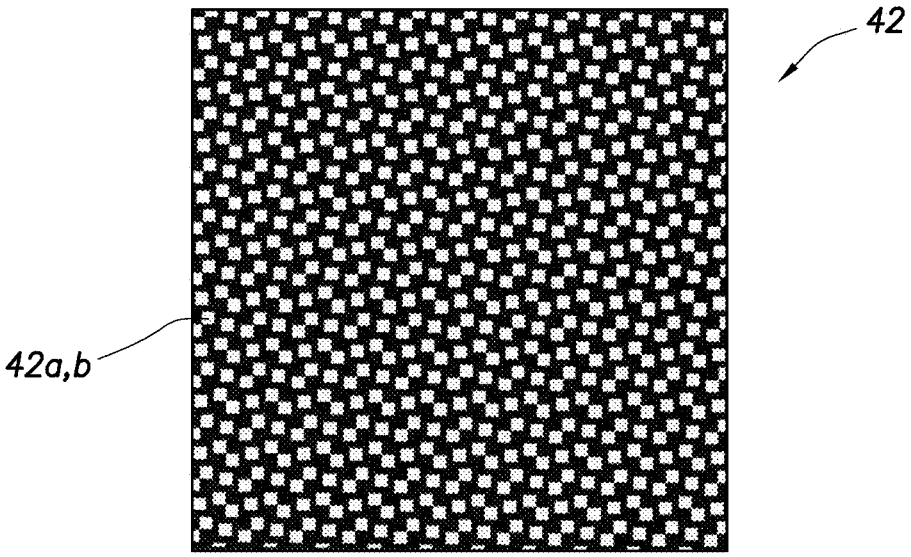

Referring additionally now to FIG. 18, another example of the seal element material 42 is representatively illustrated. In this example, a melting point or a rate of melting of the seal element material 42 can be varied.

In the FIG. 18 example, a ratio of materials 42*a,b* can be varied to thereby produce corresponding changes in the melting point or rate of melting of the seal element material 42. For example, a greater proportion of a relatively high melting point material can be used to increase the melting point of the seal element material 42. As another example, a greater proportion of a relatively high thermal conductivity material can be used to increase the rate of melting of the seal element material 42.

In most of the examples described herein and depicted in the drawings, two seal element materials 42*a,b* are used to demonstrate how properties of the seal element material 42 can be varied in the seal element 30. However, any number or combination of seal element materials may be used in keeping with the scope of this disclosure.

Furthermore, a described property or characteristic of any of the seal element materials 42*a,b* may be substituted or replaced by the property or characteristic of the other seal element material. Positions of the seal element materials 42*a,b* may be reversed or exchanged.

Any of the seal elements 30 described herein may be manufactured using the method 40 or any "additive manufacturing" techniques known to those skilled in the art by which materials can be deposited so that they accumulate to form the finished seal element 30. Such techniques allow materials, and their properties, structures and characteristics, to be varied as desired in the seal element 30.

In any of the examples described herein, properties of the seal element material 42 may be varied in the seal element 30 to change between the seal element materials 42*a,b*. There may be a gradual change from one material to another, such as, by gradually varying a ratio of the materials 42*a,b*, or by gradually varying a characteristic of the material 42 (for example, a density, size, quantity, shape, etc. of voids in the material 42). The physical properties can be changed gradually using the method 40, so that there is no distinct boundary between the materials 42*a,b*.

It may now be fully appreciated that the above disclosure provides significant advancements to the arts of designing and manufacturing sealing apparatus. In some examples described above, the seal element material 42 is deposited to form the seal element 30, with properties and characteristics of the seal element material 42 varying in the seal element 30.

A method 40 of manufacturing a seal element 30 is provided by the above disclosure. In one example, the method 40 can include: depositing a first seal element material 42*a* from an instrument 44 at a first location of the seal element 30; and depositing a second seal element material 42*b* from the instrument 44 at a second location of the seal element 30. The first seal element material 42*a* is different from the second seal element material 42*b*.

The first and second seal element materials 42*a,b* may have different densities, porosities, compressibilities, elasticities, hardnesses, toughnesses or other properties or characteristics.

The second seal element material 42*b* may have a higher compressibility than the first seal element material 42*a*, and the second location may be external relative to the first location.

The second seal element material 42*b* may have a higher density than the first seal element material 42*a*, and the second location may be external relative to the first location.

The first and second seal element materials 42*a,b* may form integral portions of a well tool structure (such as the combined seal element 30 and housing assembly 34 of the FIG. 7 example). The well tool structure may include a component selected from the group consisting of an outer housing 34 and an inner mandrel 36.

The first and second seal element materials 42*a,b* may be deposited so that the seal element 30 is more compressible in a first direction as compared to a second direction. The first direction may be an axial or longitudinal direction, and the second direction may be a radial direction. Alternatively, the first direction may be a radial direction, and the second direction may be an axial or longitudinal direction.

The second seal element material 42*b* depositing step may include depositing the second seal element material 42*b* at a third location of the seal element 30, the first location being between the second and third locations. The first seal element material 42*a* may be more compressible than the second seal element material 42*b* in this example.

The method 40 may include may include forming a relatively rigid structure 56 in the seal element 30. The structure 56 may limit compression of the seal element 30. The structure 56 may cause a portion of the seal element 30 to extend in response to compression of the seal element 30.

The structure 56 may restrict compression of the seal element 30, until a selected compressive force F is applied to the seal element 30. The structure 56 may break in response to application of the selected compressive force F.

At least one of the first and second seal element materials 42*a,b* may comprise a metal or metal alloy.

The step of depositing the second seal element material 42*b* may comprise depositing the second seal element material 42*b* external to the first seal element material 42*a*, and the second seal element material 42*b* may comprise a metal or a metal alloy.

The method 40 may include forming at least one void 50 in the seal element 30.

The steps of depositing the first and second seal element materials 42*a,b* may comprise arranging the first and second seal element materials 42*a,b* in the seal element 30, so that a first portion of the seal element 30 (such as, an anti-extrusion device 38) displaces relative to a second portion of the seal element 30 (such as, a primary sealing portion) in response to deformation of the seal element 30. A desired "programmed" or selected movement of the seal element 30 may, thus, be produced based on changes in properties or characteristics (such as, a presence or arrangement of voids 50 in the seal material 42, etc.) and arrangement or configuration of the seal element materials 42*a,b*.

Also described above is a sealing system 10. In one example, the system 10 can include a seal element 30, the seal element 30 comprising at least one seal element material 42 about at least one void 50 in the seal element 30. The seal element material 42 encloses the void 50.

A structure 56 may be formed in the seal element 30. The structure 56 may limit compression of the seal element 30, resist compression of the seal element 30 until a selected compressive force F is applied to the seal element 30, or cause a seal surface to extend from the seal element 30 in response to compression of the seal element 30.

A density, compressibility, porosity or hardness of the seal element material 42 may vary in the seal element 30.

The seal element material 42 may be deposited about the void 50 in the seal element 30.

Another sealing system 10 is provided to the art by the above disclosure. In one example, the sealing system 10 can include a seal element 30, with the seal element 30 comprising multiple different seal element materials 42*a,b* deposited at respective multiple different locations in the seal element 30.

The seal element materials 42*a,b* may have different densities, porosities, compressibilities, elasticities, hardnesses, toughnesses or other properties or characteristics.

One of the seal element materials 42*a,b* having a relatively higher compressibility may be positioned external relative to one of the seal element materials 42*a,b* having a relatively lower compressibility.

One of the seal element materials 42*a,b* having a relatively higher density may be positioned external relative to one of the seal element materials 42*a,b* having a relatively lower density.

The seal element materials 42*a,b* may form integral portions of a well tool structure. The well tool structure may include a component selected from the group consisting of an outer housing 34 and an inner mandrel 36.

The seal element materials 42*a,b* may be deposited so that the seal element 30 is more compressible in a first direction as compared to a second direction. The first direction may be an axial or longitudinal direction, and the second direction may be a radial direction. The first direction may be a radial direction, and the second direction may be an axial or longitudinal direction. However, it is not necessary that the first or second direction is an axial, longitudinal or radial direction. For example, the first or second direction could be a combination of radial and axial or longitudinal directions.

The seal element materials 42*a,b* may include a relatively more compressible first seal element material 42*a* positioned between a relatively less compressible second seal element material 42*b*.

The seal element materials 42*a,b* may include a relatively less dense first seal element material 42*a* positioned between a relatively more dense second seal element material 42*b*.

The sealing system 10 may include a relatively rigid structure 56 in the seal element 30. The structure 56 may limit compression of the seal element 30, the structure 56 may cause a portion of the seal element 30 to extend in response to compression of the seal element 30.

The structure 56 may restrict compression of the seal element 30, until a selected compressive force F is applied to the seal element 30. The structure 56 may break in response to application of the selected compressive force F.

At least one of the seal element materials 42*a,b* may comprise a metal or metal alloy. One of the seal element materials 42*a,b* on an exterior of the seal element 30 may comprise a metal or a metal alloy. One of the seal element materials 42*a,b* on an interior of the seal element 30 may comprise a metal or a metal alloy.

The sealing system 10 may include at least one void 50 in the seal element 30.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of manufacturing a seal element, the method comprising:

depositing a first seal element material from an instrument at a first location of the seal element;

depositing a second seal element material from the instrument at a second location of the seal element, the first seal element material being different from the second seal element material; and forming a structure in the seal element, in which the structure limits compression of the seal element.

2. The method of claim 1, in which a property of the first and second seal element materials is different, the property being selected from the group consisting of density, compressibility, porosity, elasticity, toughness and hardness of the seal element material.

3. The method of claim 1, in which the second seal element material has a higher compressibility than the first seal element material, and the second location is external relative to the first location.

4. The method of claim 1, in which the second seal element material has a higher density than the first seal element material, and the second location is external relative to the first location.

5. The method of claim 1, in which the first and second seal element materials form integral portions of a well tool structure.

6. The method of claim 1, in which the first and second seal element materials are deposited so that the seal element is more compressible in a first direction as compared to a second direction.

7. The method of claim 1, in which the second seal element material depositing further comprises depositing the second seal element material at a third location of the seal element, the first location being between the second and third locations.

8. The method of claim 1, in which the structure resists compression of the seal element until a selected compressive force is applied to the seal element.

9. The method of claim 1, in which at least one of the first and second seal element materials comprises a metal.

10. The method of claim 1, in which depositing the second seal element material comprises depositing the second seal element material external to the first seal element material, and in which the second seal element material comprises a metal.

11. The method of claim 1, further comprising forming at least one void in the seal element.

12. A sealing system, comprising:

a seal element, the seal element comprising at least one seal element material about at least one void in the seal element, the seal element material enclosing the void; and in which a first structure is formed in the seal element, and in which the first structure limits compression of the seal element.

13. The sealing system of claim 12, in which the first structure resists compression of the seal element until a selected compressive force is applied to the seal element.

14. The sealing system of claim 12, in which a second structure is formed in the seal element, and the second structure causes a seal surface to extend from the seal element in response to compression of the seal element.

15. The sealing system of claim 12, in which a property of the seal element material varies in the seal element, the property being selected from the group consisting of density, compressibility, porosity, elasticity, toughness and hardness of the seal element material.

16. The sealing system of claim 12, in which the seal element material is deposited about the void in the seal element.

17. A sealing system, comprising:

a seal element, the seal element comprising multiple different seal element materials deposited at respective multiple different locations in the seal element, and the seal element further comprising a structure which limits compression of the seal element.

18. The sealing system of claim 17, in which a property of the seal element materials is different, the property being selected from the group consisting of density, porosity, compressibility, elasticity, hardness and toughness.

19. The sealing system of claim 17, in which one of the seal element materials having a relatively higher compressibility is positioned external relative to one of the seal element materials having a relatively lower compressibility.

20. The sealing system of claim 17, in which one of the seal element materials having a relatively higher density is positioned external relative to one of the seal element materials having a relatively lower density.

21. The sealing system of claim 17, in which the seal element materials form integral portions of a well tool structure.

22. The sealing system of claim 17, in which the seal element materials are deposited so that the seal element is more compressible in a first direction as compared to a second direction.

23. The sealing system of claim 17, in which the seal element materials include a relatively more compressible first seal element material positioned between relatively less compressible second seal element materials.

24. The sealing system of claim 17, in which the seal element materials include a relatively less dense first seal element material positioned between relatively more dense second seal element materials.

25. The sealing system of claim 17, in which the structure resists compression of the seal element until a selected compressive force is applied to the seal element.

26. The sealing system of claim 17, further comprising at least one void in the seal element.

* * * * *